United States Patent [19]

Schulze et al.

[11] Patent Number: 4,911,078

[45] Date of Patent: Mar. 27, 1990

[54] CARTRIDGED AMMUNITION HAVING A COMBUSTIBLE CASING AND METHOD OF MAKING THE SAME

[75] Inventors: Albert Schulze, Mönchengladbach; Rahnenführer, Dormagen, both of Fed. Rep. of Germany

[73] Assignee: Rheinmetall GmbH, Düsseldorf, Fed. Rep. of Germany

[21] Appl. No.: 194,288

[22] Filed: May 16, 1988

[30] Foreign Application Priority Data

May 14, 1987 [DE] Fed. Rep. of Germany ..... 3716076

[51] Int. Cl.[4] ..... F42B 5/18

[52] U.S. Cl. ..... 102/431; 102/700

[58] Field of Search ..... 102/430–433, 102/530, 531, 700

[56] References Cited

U.S. PATENT DOCUMENTS

| | | | |
|---|---|---|---|
| 297,345 | 4/1884 | Boca | 102/431 |
| 2,991,168 | 7/1961 | Nadel . | |
| 3,185,094 | 5/1965 | Zehfeld | 102/430 |
| 3,320,886 | 5/1967 | DeLuca | 102/700 |
| 3,424,087 | 1/1969 | Hintze | 102/530 |
| 3,563,177 | 2/1971 | Ritchey | 102/431 |
| 3,658,008 | 4/1972 | Larson . | |

FOREIGN PATENT DOCUMENTS

| | | |
|---|---|---|
| 2140742 | 2/1974 | Fed. Rep. of Germany . |
| 2550208 | 12/1977 | Fed. Rep. of Germany . |

*Primary Examiner*—Harold J. Tudor

*Attorney, Agent, or Firm*—Spencer & Frank

[57] ABSTRACT

A cartridged ammunition for machine weapons, particularly for automatic weapons comprises a combustible casing composed of a casing cover, a cylindrical casing jacket and a casing base, glued to one another at annular contact regions and enclosing a propelling charge. The cartridged ammunition is manufactured by securing the tail section of the projectile in a recess of the casing cover and gluing the tail section thereto, axially inserting the projectile and casing cover into the cylindrical casing jacket through a rear open end thereof and gluing the casing cover to an inwardly extending radial shoulder of the casing jacket, filling the casing with the propelling charge and closing the rear open end of the combustible casing by gluing the casing base to the casing jacket.

5 Claims, 1 Drawing Sheet

CARTRIDGED AMMUNITION HAVING A COMBUSTIBLE CASING AND METHOD OF MAKING THE SAME

BACKGROUND OF THE INVENTION

The present invention relates to cartridged ammunition for machine weapons, particularly for automatic weapons. The ammunition includes a combustible casing, containing the propelling charge composed of loose granular matter, and a projectile fastened to the front of the casing.

Developments in the ammunitions art in connection with cartridged ammunition range from ammunition having a metal casing, which requires the unloading of the casing after firing, to caseless ammunition in which, after firing, the next cartridge can be loaded into the weapon without requiring any unloading process. For large-caliber ammunition, for example, 120 mm, the conventional metal casing is replaced by a casing which, in the cylindrical casing portion, is made of a combustible material. For reasons of obturation and defined ignition, such a casing still includes a metal base. For smaller caliber ammunition, in a range from about 20 to 40 mm, various solutions have been proposed to provide completely non-metallic casings. One such solution is to connect the projectile directly to a compressed, shape-stable propelling charge packet, where the propelling charge is composed of propelling charge granules held together by an adhesive. Other solutions include providing individually compressed rods held together by an adhesive, or a wound propelling charge body.

One of the greatest disadvantages of using such ammunition for automatic weapons firing at high cadences of, for example, 600 rounds per minute, is the intake shock, in addition to the obturation when fired.

The term "intake shock" is here understood to mean all stresses, such as impact, bending, tensile or pressure stresses, which act on the cartridge due to the high acceleration and deceleration of the cartridge when traveling from the magazine to the cartridge chamber of the weapon during the loading process or in the reverse direction during the ejecting process. Thus, during loading, these stresses frequently cause individual powder granules or edges to break off, or cause the bonded propelling charge body to break apart with a simultaneous loosening of the firm connection between the projectile and the charge body. A particular problem is encountered in making a breakage-resistant connection between the tail of the projectile and the propelling charge body, since the heavy projectile tends to break away from the propelling charge due to the inertia of the projectile or the motion energy still inherent in the projectile when the propelling charge body is stopped abruptly in the charge chamber or cartridge chamber of the weapon.

Ammunition of the above-mentioned type is disclosed in U.S. Pat. No. 3,658,008. It is composed of a projectile and a cylindrial, combustible casing of the same caliber which is made uniformly of one piece which comprises a shaped propelling agent granulate and a nitrocellulose binder, containing a small amount of nitrogen, for holding the propelling agent together. A multi-part screw connection is provided to fasten the projectile to the propelling charge casing. One end of the casing is provided with a conically contracted edge or flange, and a conically widened neck piece having external threads is inserted into the casing. A connecting ring having a bore with an internal thread is screwed onto this neck piece in such a manner that the conically constricted casing flange is clamped between the widened neck piece and the connecting ring, both of which may be made of steel or brass. The projectile is provided with an externally threaded shank screwed into the other side of the connecting ring. Because the neck piece has a larger diameter than the opening in the conical flange of the casing, the neck piece must be ground at two opposing sides and the opening in the conical flange must have two opposing recesses to enlarge its diameter to allow the neck piece to be inserted into the opening of the conical flange.

The drawbacks of this prior art ammunition are the labor-intensive and cost-intensive manufacture of all these individual parts. Complicated process steps are required to provide the projectile and the additional members with their complementary threads and opposing conical clamping faces. Therefore, the manufacture of this combustible cartridge casing as a one-piece unit having the conical flange presents production engineering difficulties.

SUMMARY OF THE INVENTION

It is an object of the present invention to provide ammunition having a combustible cartridge casing where the ammunition can be manufactured easily and economically and is free of the drawbacks of the above-described prior art types of ammunition.

This is accomplished by the present invention by, briefly stated, providing a combustible casing composed of a casing cover, a cylindrical casing jacket having a first and second end portion and a casing base, and a projectile secured to the casing. The casing cover, casing jacket and casing base are glued to one another at annular contact regions and enclose the propelling charge.

The combustible cartridge casing composed of three parts which are fixed to one another by gluing provides ammunition having a stable, shock-absorbing, closed space for the powdered propelling charge, with no components remaining for ejection after a shot is fired. Ammunition of this type is particularly suitable for economic mass production since the surfaces where the adhesive is located have the same strength as the combustible casing material itself.

The configuration of the ammunition, particularly the cup-shaped recess in the cover of the casing which encloses the entire tail section of the projectile, ensures a secure connection between the projectile and the cartridge casing. This connection is not only able to absorb the usual stresses encountered in normal use of the ammunition but also extraordinary stresses without damage to the propelling charge. Furthermore, it is not necessary to glue the powdered or granular propelling charge agent together.

DESCRIPTION OF THE PREFERRED EMBODIMENT

Figure 1:
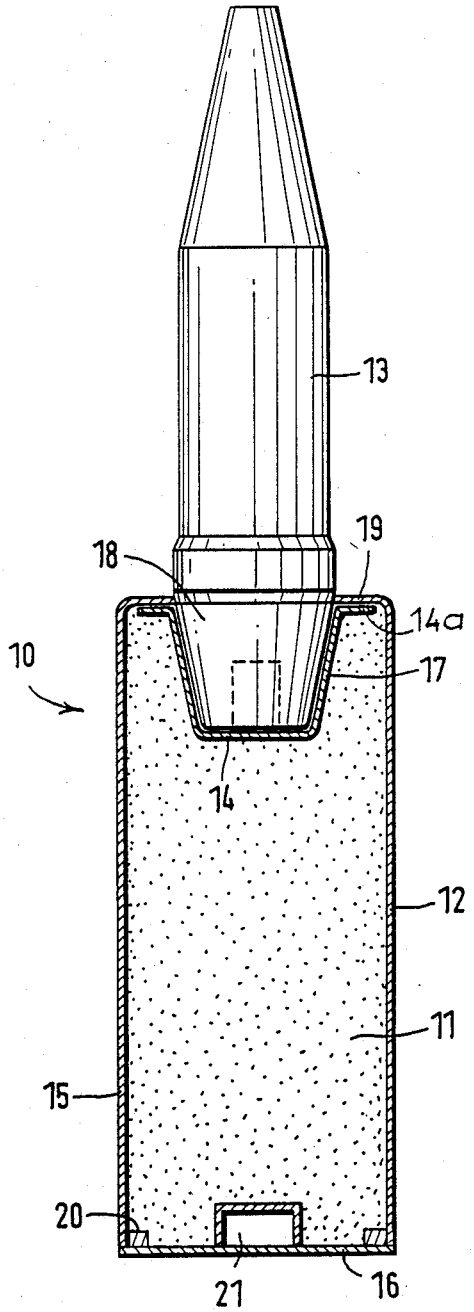
FIG. 1 is a longitudinal sectional view of a cartridged ammunition unit according to a preferred embodiment of the invention.

Turning to FIG. 1, the reference numeral 10 identifies an ammunition unit which is suitable for use in machine weapons, particularly for automatic weapons firing at high cadences, and is composed of a propelling charge 11 of loose granular matter surrounded by a combustible casing 12 having a projectile 13 attached at its front portion.

Casing 12 is composed of three prefabricated individual parts: a casing cover 14 at the front, a cylindrical casing jacket 15 and a casing base 16 at the rear (when seen in the direction of firing). The three parts are firmly glued to one another at their annular contact regions.

The production of these geometrically simple individual parts, for example, by the known needle method disclosed in German Patent. No. 1,446,889, is much simpler than the production of the one-piece casing having the conically contracted flange ring of the prior art.

To produce a firm connection between projectile 13 and combustible casing 12, which must be able to safely absorb all the stresses acting on the ammunition during loading or unloading without damage, a cup-shaped recessed part 17 is provided in casing cover 14 to accommodate and conform to the entire tail section 18 of the projectile.

In a first step in the manufacture of the ammunition unit 10, the tail section 18 of the projectile is inserted into and unreleasably glued in the recessed part 17 which completely encloses the tail section 18.

Casing jacket 15 has a radially inwardly extending shoulder (flange ring) 19 oriented perpendicularly to the casing jacket 15 at the front portion thereof, leaving an open orifice corresponding to the diameter of the tail section 18 of the projectile.

In a second manufacturing step, projectile 13 with casing cover 14 being glued thereto, is inserted axially from the rear through the casing jacket 15 so that a radially outwardly oriented circumferential shoulder 14*a* of the casing cover 14 rests against the interior face of the shoulder 19 of the casing jacket 15. The parts are then firmly glued to one another in this large contact region.

Figure 2:
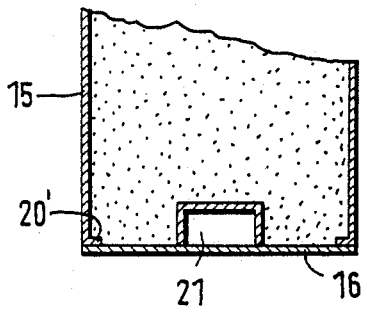
FIG. 2 is a fragmentary longitudinal sectional view of another preferred embodiment.

After the casing 12 has been filled with propelling charge 11, composed of loose granular matter, the rear casing base 16 is placed onto the cylindrical casing jacket 15 in a further manufacturing step and is firmly glued to the casing jacket 15 about its circumferential region. To reinforce this region, a separate reinforcement ring 20 made of similar combustible material and having a rectangular or triangular cross section may be provided in the interior of the casing jacket 15, thus providing a surface to which casing base 16 may be securely glued. In the alternative, as illustrated in FIG. 2, the reinforcement ring 20' is formed of a radially inwardly extending annular shoulder of the casing jacket 15. The casing base 16 also includes an igniter 21 provided in a recess in its center for igniting the propelling charge. The projectile tail section 18 may also be provided with a recess to accommodate a tracer composition.

The adhesive used in gluing together the casing over 14, the casing jacket 15, the casing base 16 and the reinforcing ring 20 may be, for example, an adhesive designated "Sichello V 4025" and made by Sichelwerke Hannover, Federal Republic of Germany.

The present invention thus provides an ammunition unit which is easily and economically mass produced and is able to withstand stresses and is insensitive to shocks which occur in the loading of the ammunition.

It will be understood that the above description of the present invention is susceptible to various modifications, changes and adaptations, and the same are intended to be comprehended within the meaning and range of equivalents of the appended claims.

What is claimed is:

1. In a cartridged ammunition including a combustible casing having front and rear end portions, a propellant contained in the casing, and a projectile held in said casing at the front end portion thereof; said projectile having a tail portion; the improvement wherein said combustible casing is formed of a cylindrical casing jacket, a casing cover situated at said front end portion and a casing base situated at said rear end portion; said cylindrical casing jacket being in circumferential engagement with said casing cover and said casing base along respective first and second annular contacting zones; said cylindrical casing jacket being glued to said casing cover and said casing base at said respective first and second annular contacting zones; said casing cover including a recessed part extending into the casing jacket and accommodating and conforming to said tail portion; said tail portion extending into the casing jacket and being glued to said recessed part of said casing cover.

2. A cartridged ammunition as defined in claim 1, wherein said casing jacket includes a radially inwardly extending circumferential flange forming a first shoulder and said casing cover includes a radially outwardly extending circumferential flange forming a second shoulder being in a face-to-face annular contact with said first shoulder to constitute said first annular contacting zone.

3. A cartridged ammunition as defined in claim 2, wherein said first shoulder has an annular face oriented towards an interior of said cylindrical casing jacket; said casing cover projecting into said interior and said second shoulder being in engagement with said annular face of said first shoulder.

4. A cartridged ammunition as defined in claim 1, further comprising a combustible reinforcement ring glued to the interior of said casing jacket at said rear end portion, said casing base being glued to said reinforcement ring.

5. A cartridged ammunition as defined in claim 1, further wherein said combustible casing has, at the rear end portion thereof, a radially inwardly extending shoulder; said casing base being glued to said shoulder.

* * * * *